US005257158A

United States Patent [19]

Smith

[11] Patent Number: 5,257,158

[45] Date of Patent: Oct. 26, 1993

[54] APPARATUS FOR MAGNETIZING AND DEMAGNETIZING A TOOL

[76] Inventor: Mack A. Smith, Rte. 4, Box 138, Hamilton, Ala. 35570

[21] Appl. No.: 782,594

[22] Filed: Oct. 25, 1991

[51] Int. Cl.[5] ..... H01F 13/00

[52] U.S. Cl. ..... 361/143; 361/146; 361/149; 335/284

[58] Field of Search ..... 361/143, 144, 145, 146, 361/148, 149, 147; 335/284

[56] References Cited

U.S. PATENT DOCUMENTS

| | | | |
|---|---|---|---|
| 2,125,628 | 8/1938 | Frederickson | 335/284 |
| 3,346,778 | 10/1967 | Schroeder et al. | 361/143 |
| 3,579,053 | 5/1971 | Littwin | 361/145 |
| 3,662,303 | 5/1972 | Arloff | 335/284 |
| 3,969,657 | 7/1976 | Oettinghaus | 361/148 |
| 4,160,283 | 7/1979 | Adams | 361/143 |
| 4,370,693 | 1/1983 | McDonald et al. | 361/145 |
| 4,591,943 | 5/1986 | Armond | 361/145 |
| 5,055,813 | 10/1991 | Johnson | 335/284 |

*Primary Examiner*—Jeffrey A. Gaffin

*Attorney, Agent, or Firm*—Nies, Kurz, Bergert & Tamburro

[57] ABSTRACT

Apparatus for selectively magnetizing and demagnetizing a small tool, such as a screwdriver, by providing an enclosure having a first opening to receive a tool for magnetizing a desired portion of the tool, and a second opening to receive a tool for demagnetizing a selected portion of the tool. The demagnetizing opening is surrounded by a demagnetizing coil that is directly connected through a first switch with a source of alternating current to provide an alternating magnetic field for demagnetizing a tool inserted into the demagnetizing opening. The magnetizing opening is surrounded by a magnetizing coil that is connected through a second switch with the source of alternating current and through a rectifier circuit to provide a continuous magnetic field for magnetizing a tool inserted into the magnetizing opening. Pilot lights are coupled with the respective magnetizing and demagnetizing loops to indicate when the respective loops are energized. The apparatus is light in weight and is enclosed within a unitary enclosure with a carrying handle for convenience.

9 Claims, 2 Drawing Sheets

APPARATUS FOR MAGNETIZING AND DEMAGNETIZING A TOOL

BACKGROUND OF THE INVENTION

1. Field of the Invention

The present invention relates to apparatus for selectively magnetizing and demagnetizing a hand tool, such as a screwdriver, a nutdriver, or the like. More particularly, the present invention relates to a portable device in the form of an enclosure, the enclosure having a pair of respective openings to permit the insertion thereinto of a tool that is either to be magnetized or to be demagnetized.

2. Description of the Related Art

It is often desirable to provide a hand tool, such as a screwdriver, a nutdriver, or the like, with a magnetized end for magnetically retaining a screw or nut in order to facilitate holding and orientation of the screw or nut as it is being applied to fasten parts together, or as it is being removed from the parts. Similarly, there also are times when it is desirable that the tip of screwdriver or a nutdriver not be magnetized, for one reason or another.

Various arrangements have been proposed to magnetize and demagnetize small hand tools utilizing various forms of magnetic electrical circuits. For example, in U.S. Pat. No. 4,160,283, which issued Jul. 3, 1979, to Ralph W. Adams, there is disclosed a magnetizing and demagnetizing tool in which a magnetizable core made from iron is provided within an encircling coil that is connected to a source of alternating current through a normally open switch that is closed to complete an electrical circuit. The device includes various mechanical elements that are movable to cause the opening and closing of a pair of contacts.

Other devices for magnetizing or demagnetizing articles are shown in U.S. Pat. Nos. 2,125,628; 3,346,778; 4,370,693; and 4,591,943.

Although the previously disclosed magnetizing devices are effective for their intended purpose, they involve complex electrical circuits or movable mechanical elements that require maintenance, repair, and adjustment, and that also result in higher weight, rendering use of such devices less convenient.

It is an object of the present invention to overcome the shortcomings of the prior art devices.

It is another object of the present invention to provide in a compact enclosure both a magnetizing and a demagnetizing circuit for conveniently magnetizing or demagnetizing small tools, and the like.

It is a still further object of the present invention to provide a relatively small, hand-held magnetizing and demagnetizing device that is of light weight and is easy to use.

SUMMARY OF THE INVENTION

Briefly stated, in accordance with one aspect of the present invention, apparatus is provided for selectively magnetizing and demagnetizing a magnetically permeable article. The apparatus includes an enclosure, and an electrical circuit carried within the enclosure and including a magnetizing loop and a demagnetizing loop. The enclosure includes a first opening positioned adjacent the magnetizing loop and a second opening positioned adjacent the demagnetizing loop, the first and second openings being spaced from each other. Each opening is of a size sufficient to permit the passage into the enclosure of magnetically permeable articles to be magnetized or demagnetized by passing the articles into the first or second openings, respectively.

A first switch is coupled with the magnetizing loop for selectively energizing the magnetizing loop by connecting the magnetizing loop with a source of electrical power. A second switch is coupled with the demagnetizing loop for selectively energizing the demagnetizing loop by connecting the demagnetizing loop with a source of electrical power.

In accordance with another aspect of the present invention, an enclosure is provided that includes a pair of spaced openings, a first opening surrounded by a coil coupled with a rectifier circuit to provide a continuous magnetic field, and a second coil surrounding a second opening and adapted to provide a continuously alternating magnetic field for demagnetization purposes.

DESCRIPTION OF THE PREFERRED EMBODIMENTS

Figure 1:
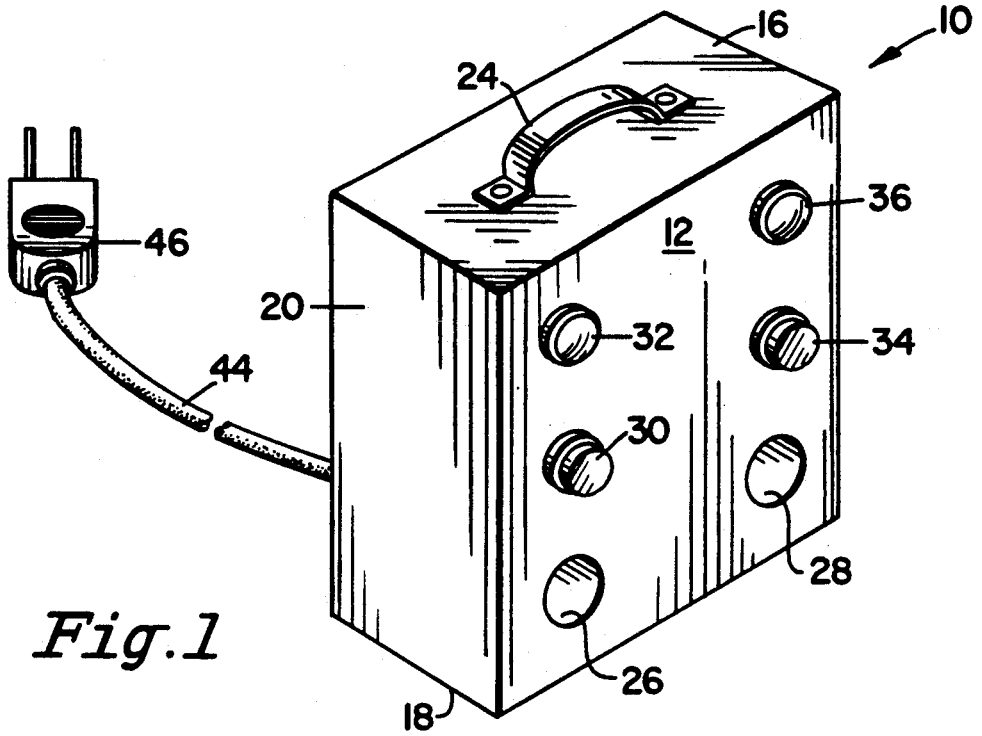
FIG. 1 is a front perspective view of an enclosure for a magnetizing and demagnetizing apparatus in accordance with the present invention.
Figure 2:
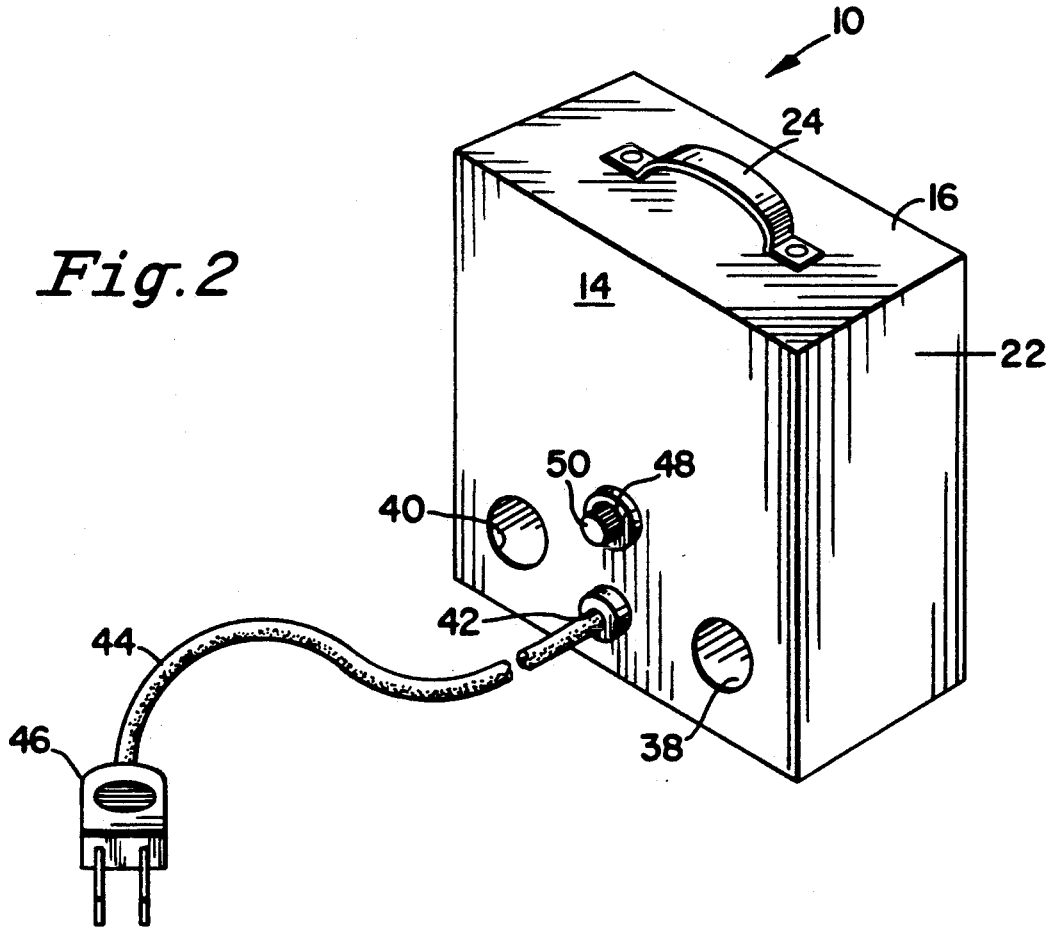
FIG. 2 is a rear perspective view of the enclosure shown in FIG. 1.

Referring now to the drawings, and particularly to FIGS. 1 and 2 thereof, there is shown an enclosure 10 of generally rectangular form. Enclosure 10 includes a front face 12, a rear face 14, a pair of upper and lower walls 16 and 18, and a pair of side walls 20, 22. Front face 12 and rear face 14 are substantially parallel with each other and are spaced from each other a distance corresponding with the widths of panels 16, 18, 20, and 22. Each of upper and lower panels 16 and 18 are also substantially parallel with and spaced from each other, as are opposed side walls 20 and 22. Thus, enclosure 10 is a substantially compact structure and includes a carrying handle 24 that extends from the upper wall.

Front face 12 includes a pair of spaced openings, a first opening 26 defining the magnetizing opening and a second opening 28 defining the demagnetizing opening. Positioned adjacent to and above magnetizing opening 26 is a spring biased, normally open switch 30 for energizing a magnetizing circuit, as will be hereinafter explained. Additionally, positioned above and adjacent to magnetizing switch 30 is a pilot light 32 that is adapted to light when the magnetizing circuit is energized, to provide a visual indication that the device is ready for magnetizing.

Positioned above demagnetizing opening 28 is a second switch 34, which can be a conventional toggle or rocker switch to selectively energize and de-energize the demagnetizing circuit. Additionally, positioned above and adjacent to demagnetizing switch 34 is a second pilot light 36, that is adapted to light when the demagnetizing circuit is energized, to provide a visual indication that the device is ready for demagnetizing.

As best seen in FIG. 2, rear face 14 of enclosure 10 includes a magnetizing opening 38 that is spaced from and aligned with magnetizing opening 26 in front face 12, and also includes a demagnetizing opening 40 that is spaced from and aligned with demagnetizing opening 28 in front face 12. Additionally, rear face 14 includes an additional opening 42 through which a line cord 44 passes, line cord 44 including a plug 46 for connecting the device with source of alternating current.

Enclosure 10 is preferably a thin-walled, plastic structure and can be made from any of a number of light weight, flexible plastic materials, such as polyethylene, polypropylene, and the like. Plastic is preferred because of light weight and also because of its non-conductive properties. The wall thickness of enclosure 10 is selected to provide a desired degree of rigidity to the respective front and rear faces and to the enclosure as a whole.

As also shown in FIG. 2, a fuse opening 48 can be provided in rear face 14 to permit a fuse 50 to extend through the wall to allow ready access to a protective fuse, and thereby avoid the need to open enclosure 10 for access to the fuse. By sealing the enclosure and providing a fuse that is accessible externally of the enclosure, tampering with or damage to the electrical circuitry contained within the enclosure is avoided.

Figure 3:
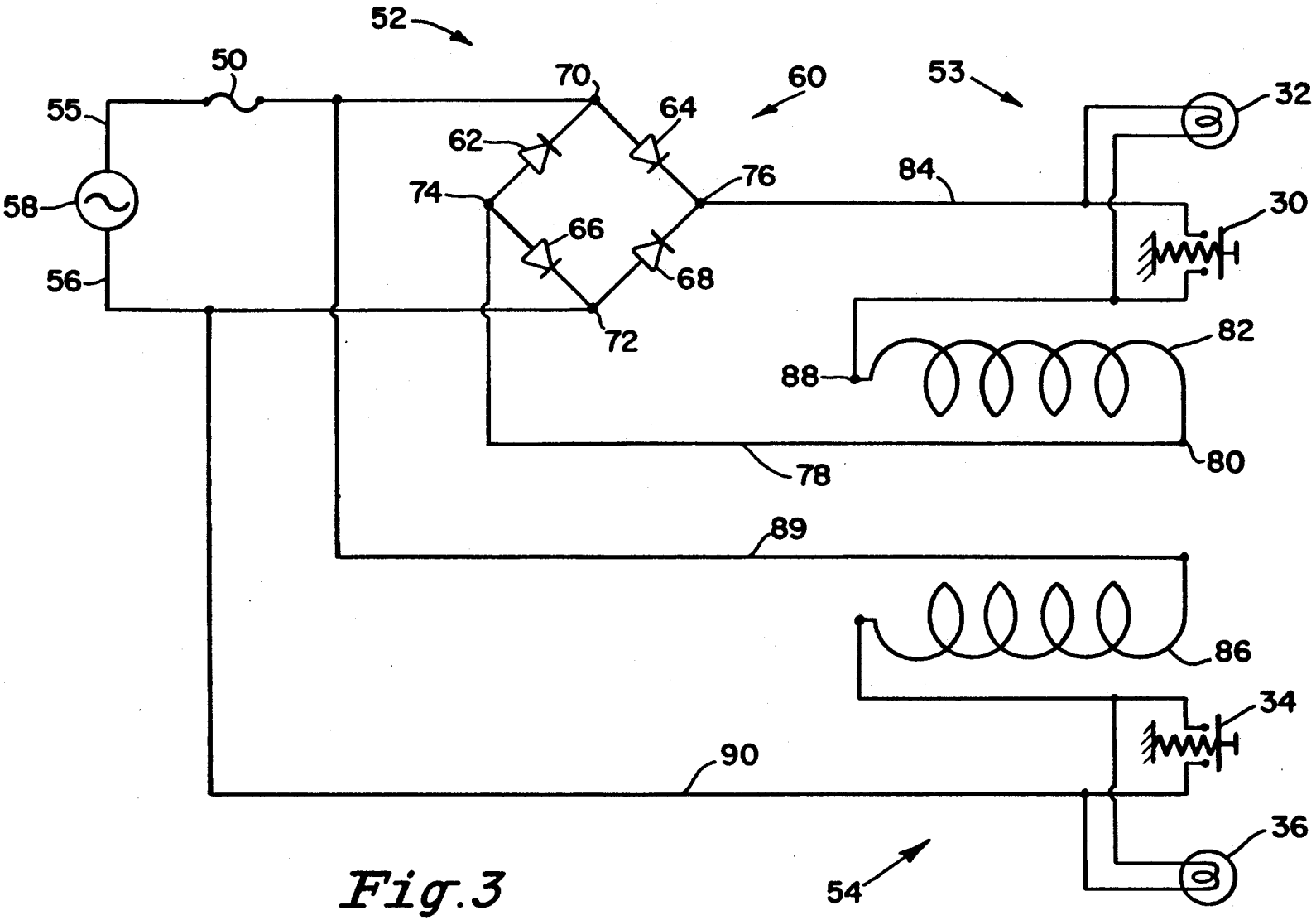
FIG. 3 is a schematic diagram of an electrical circuit that can be contained within the enclosure shown in FIGS. 1 and 2 for selectively magnetizing and demagnetizing small articles.

Referring now to FIG. 3, there is shown an electrical circuit 52 that is contained within enclosure 10 for providing the desired magnetizing and demagnetizing fields. Circuit 52 includes both a magnetizing loop 53 and a demagnetizing loop 54. A two-conductor line cord having conductors 55 and 5 is connected to a source 58 of alternating current through fuse 50.

Line conductors 55 and 56 are connected across a full-wave bridge rectifier circuit 60. Four diodes 62, 64, 66, and 68 are provided in a bridge array with each of diodes 62 and 64 having conductors connected in end-to-end relationship at node 70, and diodes 66 and 68 having conductors connected in end-to-end relationship at node 72. As shown, diodes 64 and 66 are forward-biased and diodes 62 and 68 are reversed-biased.

Node 74 defined by common points of diodes 62 and 66 is coupled through line 84 to one terminal 80 of a magnetizing coil 82, and node 76 defined by common points of diodes 64 and 68 is coupled through line 78 and through switch 30 to end 88 of magnetizing coil 82. For example, coil 82 can be a 4,000 ohm coil rated at 0.03 amps, and diodes 62, 64, 66, and 68 can each be rated at 2.5 amps.

Magnetizing circuit switch 30 is preferably a spring-biased, normally open push button switch as shown, or alternatively, it can be any of a number of types of switches, such as a toggle switch, or the like, as would be appreciated by those skilled in the art. Additionally, pilot light 32 is connected across switch 30 to provide a visual indication of when the magnetizing portion of circuit 52 is energized.

Magnetizing coil 82 is of such a diameter that it can receive within the coil loops the desired portions of tools that are intended to be magnetized, and coil 82 is so positioned within enclosure 10 that it surrounds the magnetizing openings 26 and 38 in each of front and rear faces 12 and 14, respectively, of enclosure 10.

Connected across line conductors 55, 56 between the source of current and rectifier bridge 60 is a second coil 86, through lines 88 and 90, as shown. Coil 86 is provided for demagnetizing, and can also be a 4,000 ohm coil rated at 0.03 amps. Energization of demagnetizing coil 86 can be controlled by a demagnetizing switch 34, and pilot light 36 is connected across switch 30 to provide a visual indication of energization of the demagnetizing circuit.

Demagnetizing coil 86 is of such a diameter that it can receive within the coil loops the desired portions of tools that are intended to be demagnetized, and coil 86 is so positioned within enclosure 10 that it surrounds the demagnetizing openings 28 and 40 in each of front and rear faces 12 and 14, respectively, of enclosure 10.

In operation, when it is desired to magnetize a small hand tool, such as a screwdriver, made from a magnetically permeable material, such as a ferrous-based material, plug 46 is first connected with a source of electrical power 58 to make available alternating current electrical energy to circuit 52 containing coils 82 and 86. The portion of the tool to be magnetized, such as the tip of a screwdriver, for example, is inserted into magnetizing opening 26 for a distance sufficient to insure that the tip or blade of the screwdriver intended to be magnetized is completely within enclosure 10 and is surrounded by coil 82. Magnetizing switch 30 is pressed, if it is a push-button switch, to close the switch contacts and energize the magnetizing circuit, as a result of which rectified AC current, or in essence DC current, is applied to and passes through magnetizing coil 82 to set up a constant intensity magnetic field extending around the coil and passing through the tool tip to magnetize the tool tip. After the tool has remained within the coil a few seconds, the actuating pressure on magnetizing switch 30 is removed, to thereby open the switch contacts and to cause the magnetic field within magnetizing coil 82 to collapse, whereupon the tool tip can be withdrawn from the magnetizing opening and is ready for use.

To demagnetize a previously magnetized tool, a similar procedure is followed, except that the tool tip is first inserted into demagnetizing opening 28 of enclosure 10, after which demagnetizing switch 34 is closed, to thereby set up within demagnetizing coil 34 an alternating magnetic field of varying intensity. While demagnetizing switch 34 is closed, and while the magnetic field generated by demagnetizing coil 86 is alternating both in magnitude and direction, the tool tip is slowly withdrawn from demagnetizing opening 28 and moved away from enclosure 10, after which demagnetizing switch can again be opened, with the result that the tool tip has been fully demagnetized.

It can thus be seen that the present invention provides distinct and substantial advantages over the prior art devices in that the invention incorporates both magnetizing and demagnetizing circuits within a single enclosure that can conveniently be carried from place to place. Further, because the invention does not include a relatively large number of mechanical moving parts, the resulting structure is a light weight, simple arrangement that can be contained within a small enclosure.

Although the rectifier circuit of the present invention is disclosed herein in the context of a full-wave bridge rectifier circuit, it is not limited to such an arrangement, and other types of rectifier circuits can also be employed. For example, a full-wave center tap rectifier circuit can be provided, as can a half-wave rectifier circuit, although the half-wave rectifier circuit will not provide as strong a magnetic field, and consequently the degree of magnetization of the tool will be less than that obtainable with a full-wave rectifier circuit.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within the scope of the present invention.

What is claimed is:

1. Apparatus for selectively magnetizing and demagnetizing a magnetically permeable article, said apparatus comprising:

a. an enclosure;

b. an electrical circuit contained within the enclosure and including a magnetizing loop and a demagnetizing loop, each of the magnetizing and demagnetizing loops adapted to be coupled with a unitary source of alternating current electrical power, wherein the magnetizing loop includes a rectifier for converting alternating current to substantially direct current and provides a substantially constant intensity magnetic field, and wherein the demagnetizing loop provides an alternating magnetic field, the enclosure including a first opening positioned adjacent the magnetizing loop and a second opening positioned adjacent the demagnetizing loop, the first and second openings each having a size sufficient to permit the passage therethrough and into the interior of the enclosure of a magnetically permeable article to be magnetized or demagnetized by inserting the article into the first or second openings, respectively;

c. a first switch coupled with the magnetizing loop and a source of electrical power for selectively energizing the magnetizing loop to provide the substantially constant intensity magnetic field; and d. a second switch coupled with the demagnetizing loop and the source of electrical power for selectively energizing the demagnetizing loop to provide the alternating intensity magnetic field.

2. Apparatus in accordance with claim 1, wherein the magnetizing loop includes a magnetizing coil coupled to the rectifier to produce a substantially constant intensity magnetic field.

3. Apparatus in accordance with claim 2, wherein the magnetizing coil is positioned adjacent the first opening so that an article to be magnetized that is inserted into the first opening is received within the magnetizing coil.

4. Apparatus in accordance with claim 1, wherein the rectifier is a full-wave rectifier.

5. Apparatus in accordance with claim 4, wherein the rectifier is a bridge circuit.

6. Apparatus in accordance with claim 1, wherein the demagnetizing loop includes a demagnetizing coil adapted to be connected with a source of alternating current to provide an alternating magnetic field.

7. Apparatus in accordance with claim 6, wherein the demagnetizing coil is positioned adjacent the second opening so that an article to be demagnetized that is inserted into the second opening is positioned within the demagnetizing coil.

8. Apparatus in accordance with claim 1, wherein the demagnetizing loop includes a demagnetizing coil coupled to the source of power for providing an alternating magnetic field adjacent the second opening to demagnetize a magnetized article inserted into the second opening.

9. Apparatus for selectively magnetizing and demagnetizing a magnetically permeable article, said apparatus comprising:

a. an enclosure;

b. an electrical circuit contained within the enclosure and including a magnetizing loop and a demagnetizing loop, each of the magnetizing and demagnetizing loops adapted to be coupled with a unitary source of alternating current electrical power, the magnetizing loop including a magnetizing coil and a rectifier for converting the alternating current electrical power to substantially direct current power so that the magnetizing coil provides a constant intensity magnetic field, the demagnetizing loop including a demagnetizing coil, the enclosure including a first opening positioned adjacent the magnetizing coil and a second opening positioned adjacent the demagnetizing coil, the first and second openings each having a size sufficient to permit the passage therethrough and into the interior of the enclosure of magnetically permeable articles to be magnetized or demagnetized, by inserting the articles into the first or second openings, respectively;

c. a first switch coupled with the magnetizing loop and the source of electrical power for selectively energizing the magnetizing coil to provide a substantially constant intensity magnetic field by providing the magnetizing coil with rectified alternating current electrical power; and d. a second switch coupled with the demagnetizing loop and the source of electrical power for selectively energizing the demagnetizing coil to provide an alternating magnetic field by providing the demagnetizing coil with alternating current electrical power.

* * * * *